US007102105B2

(12) United States Patent
Oh

(10) Patent No.: US 7,102,105 B2
(45) Date of Patent: Sep. 5, 2006

(54) ELECTRIC OVEN

(75) Inventor: Keun Seuk Oh, Suwon-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 11/175,219

(22) Filed: Jul. 7, 2005

(65) Prior Publication Data

US 2006/0131298 A1 Jun. 22, 2006

(30) Foreign Application Priority Data

Dec. 21, 2004 (KR) ..... 10-2004-0109735

(51) Int. Cl.
*A21B 1/00* (2006.01)

(52) U.S. Cl. ..... 219/400; 219/388; 219/401; 219/413; 126/20; 126/21 A; 126/22; 99/474; 99/475; 99/476

(58) Field of Classification Search ..... 219/400, 219/401, 388, 413; 126/20, 21 A, 22; 99/474–476

See application file for complete search history.

(56) References Cited

U.S. PATENT DOCUMENTS 4,585,923 A * 4/1986 Binder ..... 219/400

FOREIGN PATENT DOCUMENTS

| | | | |
|---|---|---|---|
| JP | 6-34137 | A | 2/1994 |
| KR | 10-2002-0042347 | A | 6/2002 |
| KR | 10-2002-0054877 | A | 6/2002 |
| KR | 10-2004-0067381 | A | 7/2004 |

* cited by examiner

*Primary Examiner*—Shawntina Fuqua
(74) *Attorney, Agent, or Firm*—Sughrue Mion, PLLC

(57) ABSTRACT

An electric oven including lower heaters arranged under a cooking chamber thereof. The electric oven includes an outer case defining the appearance of the electric oven, an inner case inwardly spaced apart from the outer case by a predetermined distance, and lower heaters arranged between bottom walls of the outer and inner cases. The inner case internally defines a cooking chamber, and a blowing fan is installed near the lower heaters to circulate air existing in the cooking chamber toward the lower heaters. With the electric oven configured as stated above, heat generated by the lower heaters is transferred to the cooking chamber in the form of conductive heat and convective heat, resulting in fast and efficient heat transfer and even cooking of food.

10 Claims, 2 Drawing Sheets

ELECTRIC OVEN

CROSS-REFERENCE TO RELATED APPLICATION

This application claims priority from Korean Patent Application No. 2004-109735, filed on Dec. 21, 2004 in the Korean Intellectual Property Office, the disclosure of which is incorporated herein by reference.

BACKGROUND OF THE INVENTION

1. Field of the Invention

The present invention relates to an electric oven and, more particularly, to a heater to heat a lower region of a cooking chamber.

2. Description of the Related Art

Electric ovens are appliances used for baking or roasting food by circulating air existing in a cooking chamber to heaters, causing the air, heated by the heaters, to heat the interior of the cooking chamber. An example of such conventional electric ovens is disclosed in Korean Patent Laid-open Publication No. 2004-0067381. The disclosed conventional electric oven comprises an outer casing defining the appearance of the electric oven, an inner casing mounted in the outer casing and internally defining a cooking chamber which is selectively opened or closed by a door, and a plurality of heaters mounted at corresponding positions of respective walls of the inner casing, except for a wall formed with a door opening. That is, a lower heater is externally mounted to a bottom wall of the inner casing, lateral heaters are externally mounted to both side walls of the inner casing, an upper heater is internally mounted to a top wall of the inner casing, and a convection heater is externally mounted to a rear wall of the inner casing. Heat from the convection heater is transferred into the cooking chamber under operation of a convection fan.

However, the above described conventional electric oven has a drawback in that the lower heater exhibits a low heat transfer efficiency since it is mounted outside the inner casing and thus part of the heat generated by the lower heater is not transferred into the cooking chamber. Meanwhile, the heat from the lower heater is transferred to the bottom wall of the inner casing mainly in a conduction manner and is used to heat food placed in the cooking chamber. Such conductive heating, however, tends to lengthen cooking time since it involves slow heat transfer. Furthermore, this makes a temperature distribution in a lower region of the inner casing vary depending on the shape of the lower heater, resulting in uneven cooking of the food placed in the cooking chamber.

SUMMARY OF THE INVENTION

Therefore, the present invention has been made in order to solve the above problems, and it is an aspect of the invention to provide an electric oven which can ensure high heat transfer efficiency from lower heaters to a cooking chamber, resulting in an improved heat efficiency of the electric oven.

It is another aspect of the invention to provide an electric oven which can ensure fast, effective heat transfer from lower heaters to a cooking chamber, resulting in a reduced cooking time.

It is yet another aspect of the invention to provide an electric oven which can ensure uniform temperature distribution in the lower region of an inner case, enabling even cooking of food.

Additional aspects and/or advantages of the invention will be set forth in part in the description which follows and, in part, will be apparent from the description, or may be learned by practice of the invention.

In accordance with one aspect, the present invention provides an electric oven comprising: an outer case; an inner case inwardly spaced apart from the outer case by a predetermined distance and internally defining a cooking chamber; lower heaters arranged between the outer case and the inner case under the cooking chamber; an air channel to circulate air existing in the cooking chamber to the vicinity of the lower heaters; and a blowing fan mounted in the air channel.

A plurality of through-holes may be formed close to lower ends of opposite side walls of the inner case, so as to communicate the cooking chamber with the air channel.

A guide may be arranged near the blowing fan to guide a flow of air.

The lower heaters may be located respectively at opposite sides of the blowing fan.

The electric oven may further comprise: an upper grill heater arranged in an upper portion of the cooking chamber to apply radiant heat to food placed in the cooking chamber, that is, to cook the food in a grill heating operation thereof.

The inner case of the electric oven may further comprise at a rear wall portion thereof a rearwardly protruding structure that defines an interior space in which a convection heater and a convection fan are disposed in order to heat an interior of the cooking chamber.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
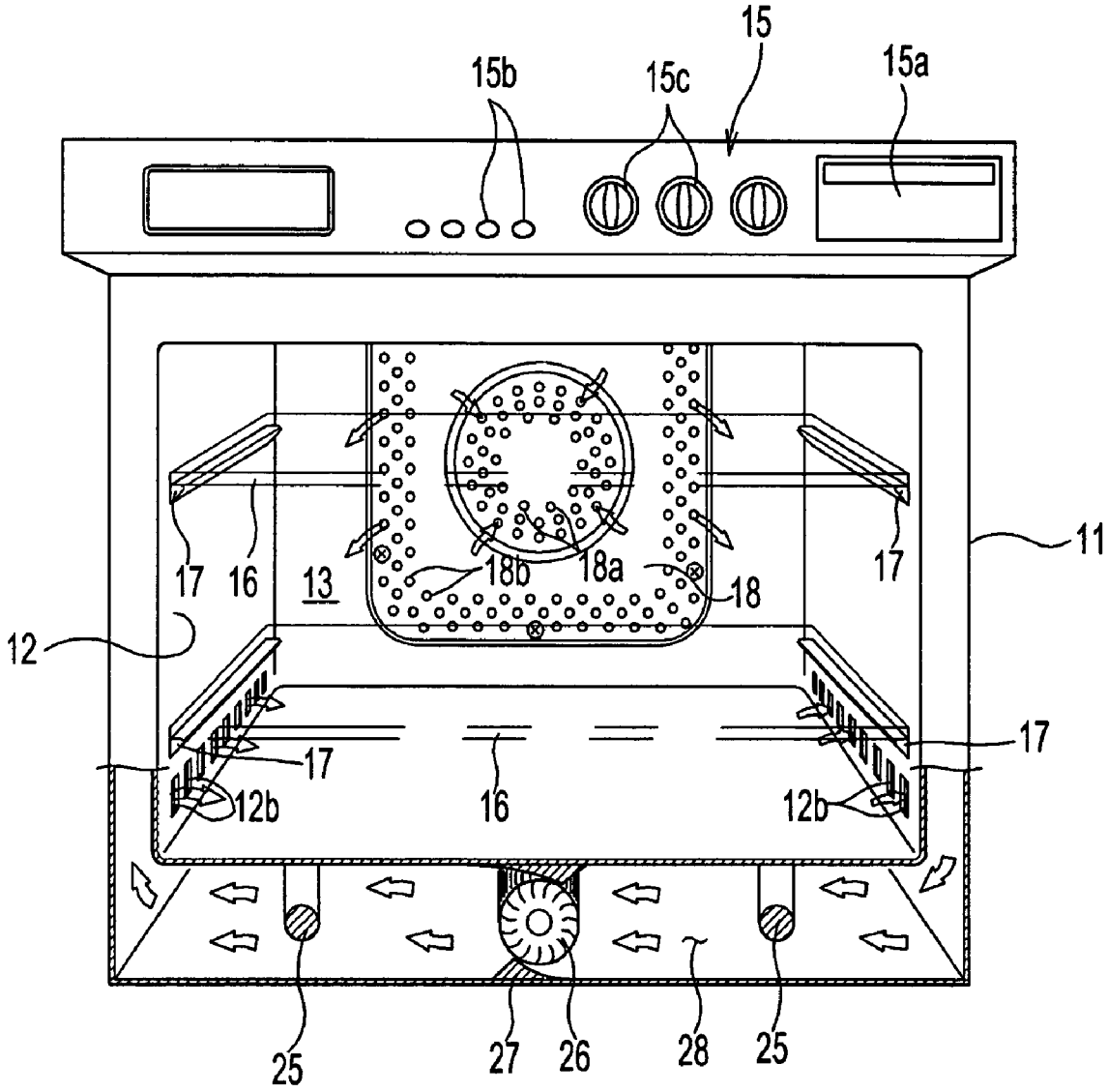
FIG. 1 is a front view showing an electric oven consistent with an exemplary embodiment of the present invention.

DETAILED DESCRIPTION OF THE ILLUSTRATIVE, NON-LIMITING EMBODIMENTS OF THE INVENTION

Reference will now be made in detail to an illustrative, non-limiting embodiment of the present invention, examples of which are illustrated in the accompanying drawings, wherein like reference numerals refer to like elements throughout. The exemplary embodiment is described below to explain the present invention by referring to the figures.

Figure 2:
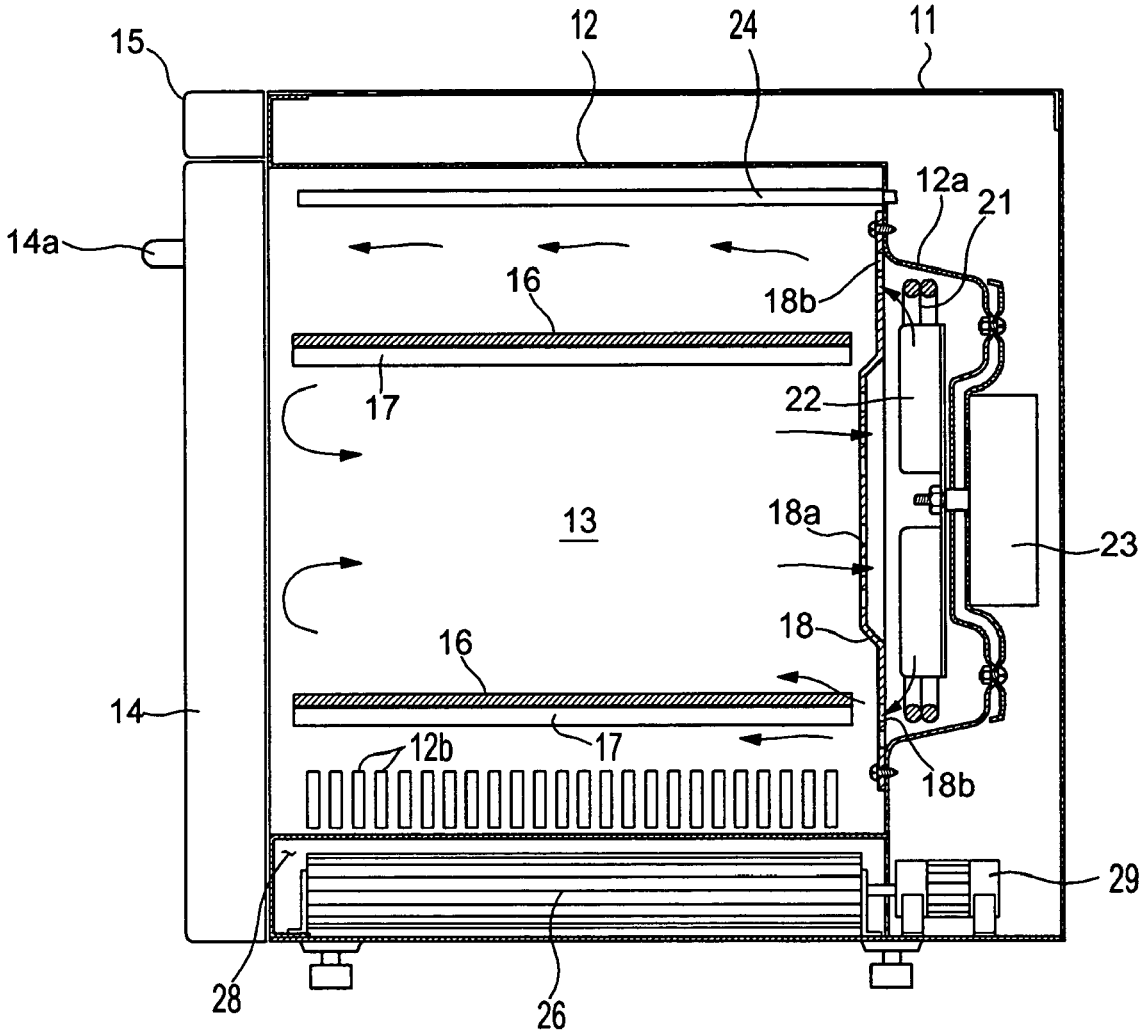
FIG. 2 is a side sectional view of the electric oven shown in FIG. 1.

FIGS. 1 and 2 are views illustrating an electric oven consistent with an exemplary embodiment of the present invention. As shown in FIGS. 1 and 2, the electric oven comprises an outer case 11 defining the appearance of the electric oven and made of, for example, an iron plate, and an inner case 12 inwardly spaced apart inward from the outer case 11 by a predetermined distance. The inner case 12 internally defines a cooking chamber 13 that receives food to be cooked. The outer and inner cases 11 and 12 have an opening at a front portion thereof to allow the user to put food into or take it out of the cooking chamber 13. A door 14 is hingably coupled to a lower end of a front wall of the outer case 11 such that it is vertically hingable to open or close the opening. A handle 14*a* is provided at an upper end of the door 14 to allow the user to conveniently operate the door 14.

An operating panel 15 is mounted to the front wall of the outer case 11 over the door 14 to control operation of the electric oven. The operating panel 15 includes a display 15*a* to display an operating state of the electric oven, a plurality of operating buttons 15*b*, and operating knobs 15*c*.

One or more racks 16 adapted to place food, to be cooked, thereon are arranged in the cooking chamber 13. Guide rails 17 are provided at opposite inner portions of side walls of the inner case 12 in order to slidably support the racks 16. The racks 16 are detachably coupled to the guide rails 17, so as to enable selective use thereof as occasion demands.

The inner case 12 has a rearwardly protruding structure 12*a* at a rear wall portion thereof. The protruding structure 12*a* defines an interior space in which a convection heater 21 and a convection fan 22 are installed to heat the interior of the cooking chamber 13. The convection heater 21 is an annular resistance heater for generating heat. The convection fan 22 is mounted in the center of the convection heater 21, and includes a centrifugal fan that sucks air from the center of a front side thereof to blow the air in a circumferential direction. A fan motor 23 is mounted behind the protruding structure 12*a* to drive the convection fan 22.

A hot air cover 18 is arranged in front of the protruding structure 12*a* to guide suction and discharge of air. The hot air cover 18 has a plurality of inlet holes 18*a* circularly arranged in the center thereof, and a plurality of outlet holes 18*b* arranged around the inlet holes 18 in an approximately square pattern. When the convection fan 22 rotates upon driving of the fan motor 23, the air existing in the cooking chamber 13 is introduced from the cooking chamber 13 to the convection fan 22 via the center inlet holes 18*a* of the hot air cover 18 by making use of a blowing force of the convection fan 22. The introduced air is heated by the convection heater 21 while being blown in a radial direction of the convection fan 22, and then is discharged into the cooking chamber 13 via the outlet holes 18*b* of the hot air cover 18.

An upper grill heater 24 is arranged at an upper portion of the cooking chamber 13 to apply radiant heat to the food placed in the cooking chamber 13, that is, to cook the food in a grill heating operation thereof.

Two lower heaters 25 are arranged in a space between the outer case 11 and the inner case 12 under the cooking chamber 13. The space between the outer and inner cases 11 and 12 under the cooking chamber 13 defines an air channel 28 through which the air existing in the cooking chamber 13 circulates. A blowing fan 26 is disposed between the two lower heaters 25 and adapted to create a flow of air circulating through the cooking chamber 13 and the air channel 28. In the exemplary embodiment of the present invention, the blowing fan 26 of the electric oven is a conventional cross-flow fan, and a guide 27 is arranged around the blowing fan 26 to guide the flow of air. A fan motor 29 is arranged near the blowing fan 26 to drive the blowing fan 26. In order to enable air communication between the cooking chamber 13 and the air channel 28, a plurality of through-holes 12*b* are formed close to lower ends of the opposite side walls of the inner case 12. With such a configuration, part of heat generated by the lower heaters 25 is transferred to the bottom wall of the inner case 12 to be transferred to the cooking chamber 13 in a conduction manner, and the other part of the heat is transmitted to the cooking chamber 13 in a convection manner by virtue of the air circulating through the air channel 28 and the cooking chamber 13.

Now, operation of the electric oven according to the above described exemplary embodiment of the present invention will be explained.

In the electric oven according to the illustrated embodiment of the present invention, food is mainly heated by means of the convection heater 21. The upper grill heater 24 and the lower heaters 25 serve only as auxiliary heating sources.

For cooking food, the user opens the door 14 and puts food into the cooking chamber 13, and then operates the operating panel 15 to cook the food in a desired mode. Once the electric oven operates, the convection heater 21 generates heat and the fan motor 23 rotates the convection fan 22, causing air existing in the cooking chamber 13 to be heated while circulating around the convection heater 21. Thereby, the food placed in the cooking chamber 13 is heated and cooked by the circulating hot air.

The upper grill heater 24, as an auxiliary heating source, is adapted to apply radiant heat to the food. Thus, the upper grill heater 24 is suitable to roast the food.

The lower heaters 25 are adapted to heat the food by making use of convective heat of the air circulating through the cooking chamber 13 as well as conductive heat of the bottom wall of the inner case 12.

As apparent from the above description, the present invention provides an electric oven which can allow heat, generated by lower heaters, to be transferred into a cooking chamber in the form of both conductive heat and convective heat. This has the effect of considerably reducing a cooking time by virtue of fast heat transfer, and allowing a great deal of heat to be transferred into the cooking chamber without loss, resulting in an improved heat efficiency.

Further, according to the present invention, a flow of air circulating through an air channel defined around the lower heaters acts uniformly to heat a bottom wall of an inner case, achieving uniform temperature distribution in a lower region of the cooking chamber and consequently even cooking of food.

Although an exemplary embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An electric oven comprising:

an outer case;

an inner case inwardly spaced apart from the outer case by a predetermined distance and internally defining a cooking chamber;

lower heaters arranged between the outer case and the inner case under the cooking chamber;

an air channel to circulate air existing in the cooking chamber to the vicinity of the lower heaters; and a blowing fan mounted in the air channel and disposed under the cooking chamber.

2. The oven according to claim 1, wherein a plurality of through-holes are formed close to lower ends of opposite side walls of the inner case, so as to communicate the cooking chamber with the air channel.

3. The oven according to claim 2, wherein a guide is arranged near the blowing fan to guide a flow of air.

4. The oven according to claim 3, wherein the lower heaters are located respectively at opposite sides of the blowing fan.

5. The oven according to claim 1, further comprising:

an upper grill heater arranged in an upper portion of the cooking chamber to apply radiant heat to food placed in the cooking chamber, that is, to cook the food in a grill heating operation thereof.

6. The oven according to claim 1, wherein the inner case has at a rear wall portion thereof a rearwardly protruding structure that defines an interior space in which a convection heater and a convection fan are disposed in order to heat an interior of the cooking chamber.

7. The oven according to claim 6, wherein the protruding structure includes a hot air cover arranged at a front thereof, the hot air cover having a plurality of air inlet holes and a plurality of air outlet holes.

8. The oven according to claim 6, wherein the convection heater comprises an annular member, and the convection fan comprises a centrifugal fan centrally disposed within the annular member.

9. An electric oven comprising:

an outer case;

an inner case inwardly spaced apart from the outer case by a predetermined distance;

lower heaters arranged in a space defined between bottom walls of the outer and inner cases;

through-holes to communicate the interior of the inner case with the space defined between the bottom walls of the outer and inner cases; and a blowing fan disposed in the space defined between the bottom walls to circulate air existing in the inner case to the vicinity of the lower heaters.

10. An electric oven comprising:

an outer case;

an inner case inwardly spaced apart from the outer case by a predetermined distance and internally defining a cooking chamber, the inner case having a rear wall portion;

a convection heater an a convection fan disposed on the rear wall portion and operative to heat an interior of the cooking chamber;

lower heaters arranged between the outer case and the inner case under the cooking chamber;

an air channel to circulate air existing in the cooking chamber to the vicinity of the lower heaters; and a blowing fan mounted in the air channel and disposed under the cooking chamber.

* * * * *